US009531107B1

(12) United States Patent
Baldwin et al.

(10) Patent No.: US 9,531,107 B1
(45) Date of Patent: Dec. 27, 2016

(54) TAMPER RESISTANT POWER TAP

(71) Applicants: Jeffrey Baldwin, Desert Hills, AZ (US); John Klein, Gilbert, AZ (US); Ryan Liebengood, Gilbert, AZ (US)

(72) Inventors: Jeffrey Baldwin, Desert Hills, AZ (US); John Klein, Gilbert, AZ (US); Ryan Liebengood, Gilbert, AZ (US)

( * ) Notice: Subject to any disclaimer, the term of this patent is extended or adjusted under 35 U.S.C. 154(b) by 0 days.

(21) Appl. No.: 14/694,434

(22) Filed: Apr. 23, 2015

Related U.S. Application Data

(60) Provisional application No. 61/988,257, filed on May 4, 2014.

(51) Int. Cl.
*H01R 13/44* (2006.01)
*H01R 13/447* (2006.01)
*H01R 25/00* (2006.01)
*H01R 13/639* (2006.01)

(52) U.S. Cl.
CPC ..... *H01R 13/447* (2013.01); *H01R 25/003* (2013.01); *H01R 13/6397* (2013.01)

(58) Field of Classification Search
USPC ..... 439/133–135, 367, 369
See application file for complete search history.

(56) References Cited

U.S. PATENT DOCUMENTS 2,903,669 A * 9/1959 Gilman ..... H01R 13/6392 174/135
3,524,029 A * 8/1970 Laff ..... H01R 13/639 200/43.02
4,063,110 A * 12/1977 Glick ..... H01R 13/6397 174/67
4,424,407 A * 1/1984 Barbic ..... H01R 13/447 174/67
4,479,688 A * 10/1984 Jennings ..... H01R 13/6397 200/43.02
4,643,505 A * 2/1987 House ..... H01R 13/6392 174/92
4,647,735 A * 3/1987 Sicher ..... H01H 27/06 200/332.1
4,659,161 A * 4/1987 Holcomb ..... H01R 31/02 439/490
5,129,839 A * 7/1992 VanSkiver ..... H01R 13/6392 439/367
5,434,368 A * 7/1995 Hoffmann ..... H01R 13/6397 200/43.22
5,731,763 A * 3/1998 Herweck ..... H01H 9/0235 200/43.22
5,834,690 A * 11/1998 Bastiaansen ..... H01R 13/6392 174/551
5,857,875 A * 1/1999 Hsu ..... G06F 1/266 439/652
5,913,692 A * 6/1999 Targett ..... H01R 13/6397 439/367
6,012,941 A * 1/2000 Burdenko ..... H01R 13/60 174/67

(Continued)

*Primary Examiner* — Tho D Ta
(74) *Attorney, Agent, or Firm* — Ryan Leibengood

(57) ABSTRACT

A power tap including a body having an electrical plug receiving portion, an electrical receptacle portion on the body, a current transmitter connecting the electrical plug receiving portion and the electrical receptacle, and a cavity in the electrical plug receiving portion. The electrical plug receiving portion may further include a cover for opening and closing access to the cavity.

11 Claims, 6 Drawing Sheets

(56) References Cited

U.S. PATENT DOCUMENTS

| | | | | |
|---|---|---|---|---|
| 6,454,579 | B1 * | 9/2002 | Davis | H01R 13/6397 439/134 |
| 6,881,910 | B2 * | 4/2005 | Fox | H01H 27/00 200/43.22 |
| 7,465,182 | B1 * | 12/2008 | McDonald | H01R 13/6392 439/369 |
| 8,123,537 | B2 * | 2/2012 | Tsuruta | H01R 13/44 439/133 |

* cited by examiner

TAMPER RESISTANT POWER TAP

CROSS-REFERENCE TO RELATED APPLICATIONS

This application claims priority to Provisional U.S. Patent Application No. 61/988,257, filed on May 4, 2014 and titled TAMPER RESISTANT POWER TAP to Baldwin et al., the disclosure of which is hereby incorporated herein by reference.

BACKGROUND

Extension cords and electrical cords in general are well known. During various tasks, multiple electrical devices may be needed and power taps permit an efficient way to power multiple devices. Known power taps only generally include an internal wiring structure which conveys electricity to all power tap receptacles simultaneously in parallel.

SUMMARY

Aspects of this disclosure relate to a power tap. In one aspect, a power tap may include a body having an electrical plug receiving portion, an electrical receptacle portion on the body, a current transmitter connecting the electrical plug receiving portion on the electrical receptacle, and a tamper resistant assembly positioned within the electrical receptacle portion.

In an implementation, the electrical plug receiving portion may further include a male electrical plug. The electrical receptacle portion may further include a female electrical receptacle. The electrical receptacle portion may further includes more than one female electrical receptacle. The electrical plug receiving portion may further include a cavity. The electrical plug may be secured within the cavity. A retainer may be positioned in contact with the electrical plug. The retained may be selectively positioned within the cavity at more than one position. The body may further include a cover for opening and closing the cavity.

The power tap may include at least one seal on the cavity. The taper resistant assembly may include a shutter system. The tamper resistant assembly may include an electrically isolating feature. The electrical receptacle portion may include a locking mechanism. The electrical plug receiving portion may be accessible only when the cover is open. The cover may include a clasping mechanism. The cavity may include a plurality of slots. The plurality of slots may be arranged to receive the retainer. The current transmitter may be a plurality of wires.

In another aspect, a power tap includes a body having an electrical plug receiving portion, an electrical receptacle portion on the body, a current transmitter connecting the electrical plug portion and the electrical receptacle, and a cavity in the electrical plug receiving portion.

In an implementation, the electrical plug receiving portion may include a cover for opening and closing access to the cavity.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and.

DETAILED DESCRIPTION

Figure 1:
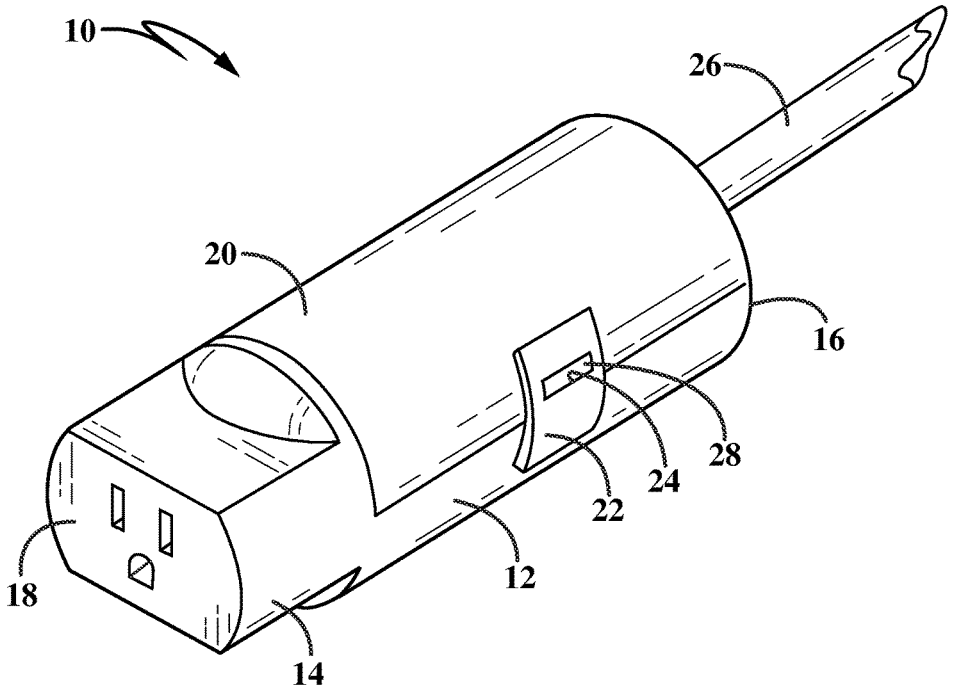
FIG. 1 is a perspective view of a power tap in the closed position with an electrical cable and plug therein.
Figure 2:
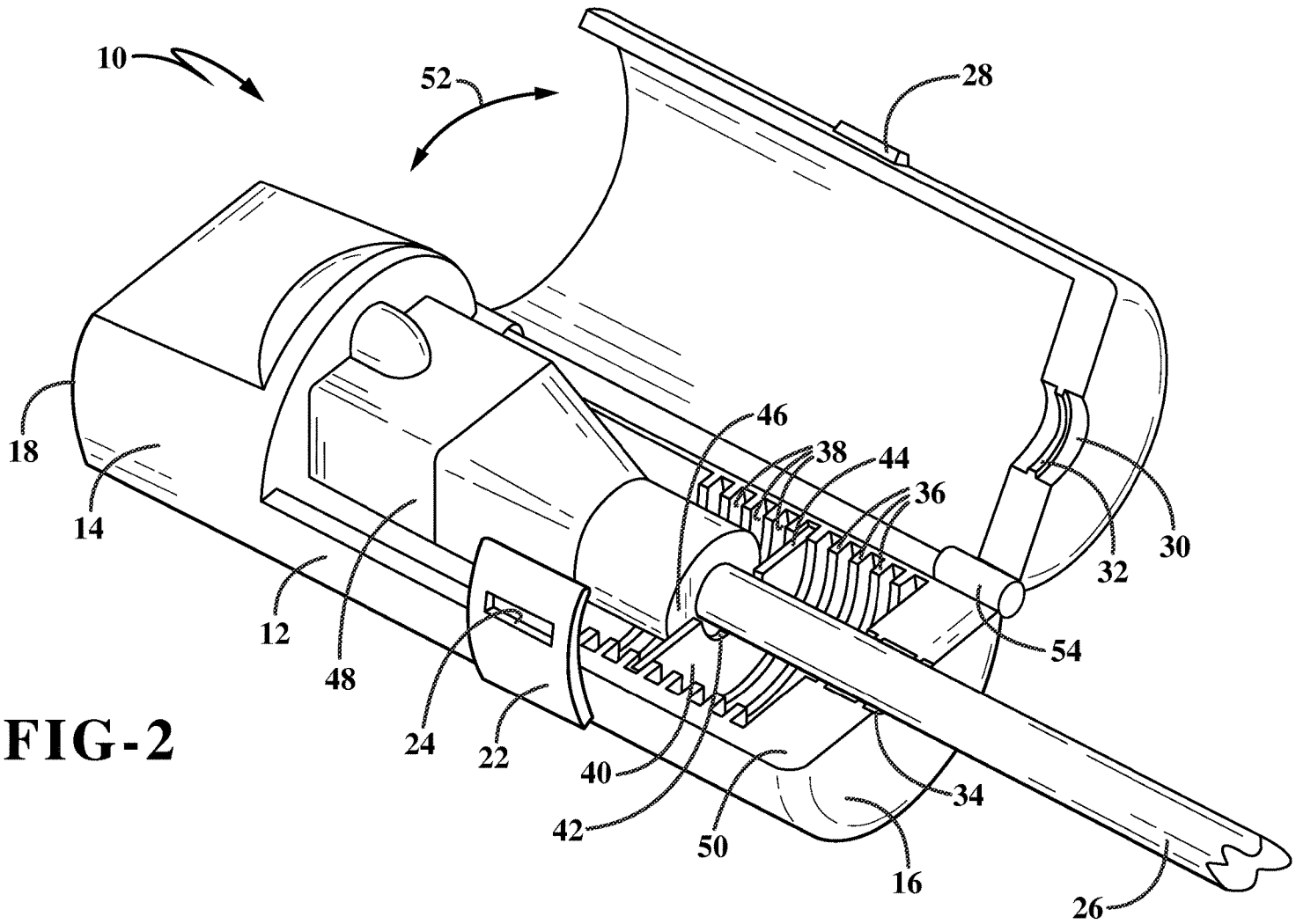
FIG. 2 is a perspective view of the power tap in the open position with an electrical cable and plug therein.
Figure 3:
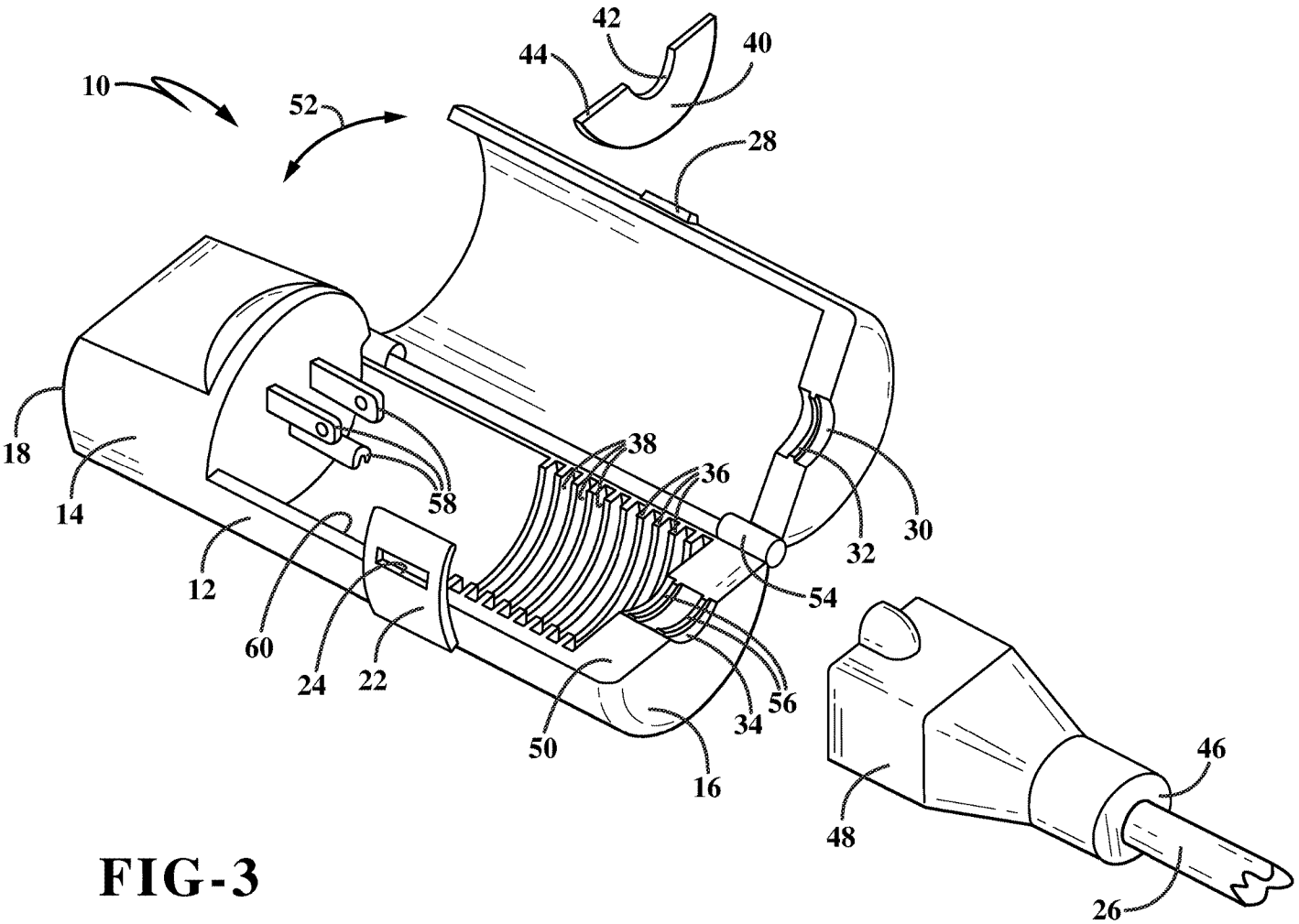
FIG. 3 is a perspective exploded view of the power tap.

This disclosure, its aspects and implementations, are not limited to the specific components or assembly procedures disclosed herein. Many additional components and assembly procedures known in the art consistent with the intended operation and assembly procedures for a power tap will become apparent for use with implementations of a power tap from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of a power tap.

FIGS. 1-4 illustrate a first aspect power tap 10 having a body 12 with an electrical plug receiving portion 58 therein with male electrical prongs or other suitable connections. Body 12 may also include an electrical receptacle portion 18 on a first end 14 opposite a second end 16. A cover 20 is pivotably secured to body 12 at a hinge 54 and is used to open or close access to a cavity 60 within body 12. Body 12 may also include a clasping mechanism 22 having an aperture 24 arranged to receive clasping tab 28 such that the cover is secured in the closed position unless the user manipulates the clasping mechanism 22 to forcibly open cover 20.

An electrical cord 26 includes an electrical plug 48 having a rear surface 46 which is received in cavity 60 of body 12 to electrically connect the electrical cord and power tap 10. Power tap 10 may include a current transmitter between electrical receptacle portion 18 and electrical plug receiving portion 58 which may be a circuit board, electrical wires, or any other electrical transmission component known in the art to those of ordinary skill. In order to make the power tap 10 and electrical cord 26 safer, a tamper resistant assembly may be positioned near first end 14 and directly behind electrical receptacle portion 18 such that the current transmitter within the power tap is not accessible unless the tamper resistant feature is overcome. Tamper resistant electrical receptacles are well known in the electrical industry and are commonplace in many households and are manufactured by companies such as Leviton, Pass & Seymour, and Hubbell, any of the designs of which may be incorporated without departing from the spirit and scope of the present disclosure.

The tamper resistant assembly may be a shutter system or an electrically isolating feature whereby electrical current does not communicate with the electrical receptacle portion 18 unless an electrical plug is properly inserted. Still further, electrical receptacle portion 18 may include a feature to lock an electrical plug to the electrical receptacle portion 18 such that the electrical plug cannot be removed without first unlocking the electrical plug. Cover 20 may also provide an electrically isolating feature in that when cover 20 is not in the closed position, the electrical transmission component electrically disconnects the electrical receptacle portion 18 and electrical plug receiving portion 58.

Moving back to cover 20, a rear portion includes a recessed region 30 having a seal 32 therein. Recessed region 30 may be generally semi-circular in shape in order to accommodate a traditional electrical cord. A recessed region 34 in second end 16 on surface 50 and may also be located near recessed region 30. Recessed region 34 may also include one or more seals 56 therein which may be positioned on either side of seal 32 to provide a more efficient sealing mechanism around an electrical cord 26 when cover 20 is in the closed position.

Cavity 60 may include a plurality of features 36 forming a plurality of slots 38 therein for receiving a retainer 40. Retainer 40 may be generally circular, semi-circular, square, or any other suitable shape and is positioned directly behind electrical plug rear surface 46. Retainer 40 includes a recessed portion 42 for receiving electrical cord 26 and a top surface 44 to permit cover 20 to pivot to a closed position in the direction associated with arrows 52. In operation, retainer 40 may be installed with or after the electrical cord 26 and when semi-circular, the retainer can be rotated around electrical cord 26 into slots 38 to thereby retain the electrical cord 26 within cavity 60 and secure to power tap 10.

Figure 4:
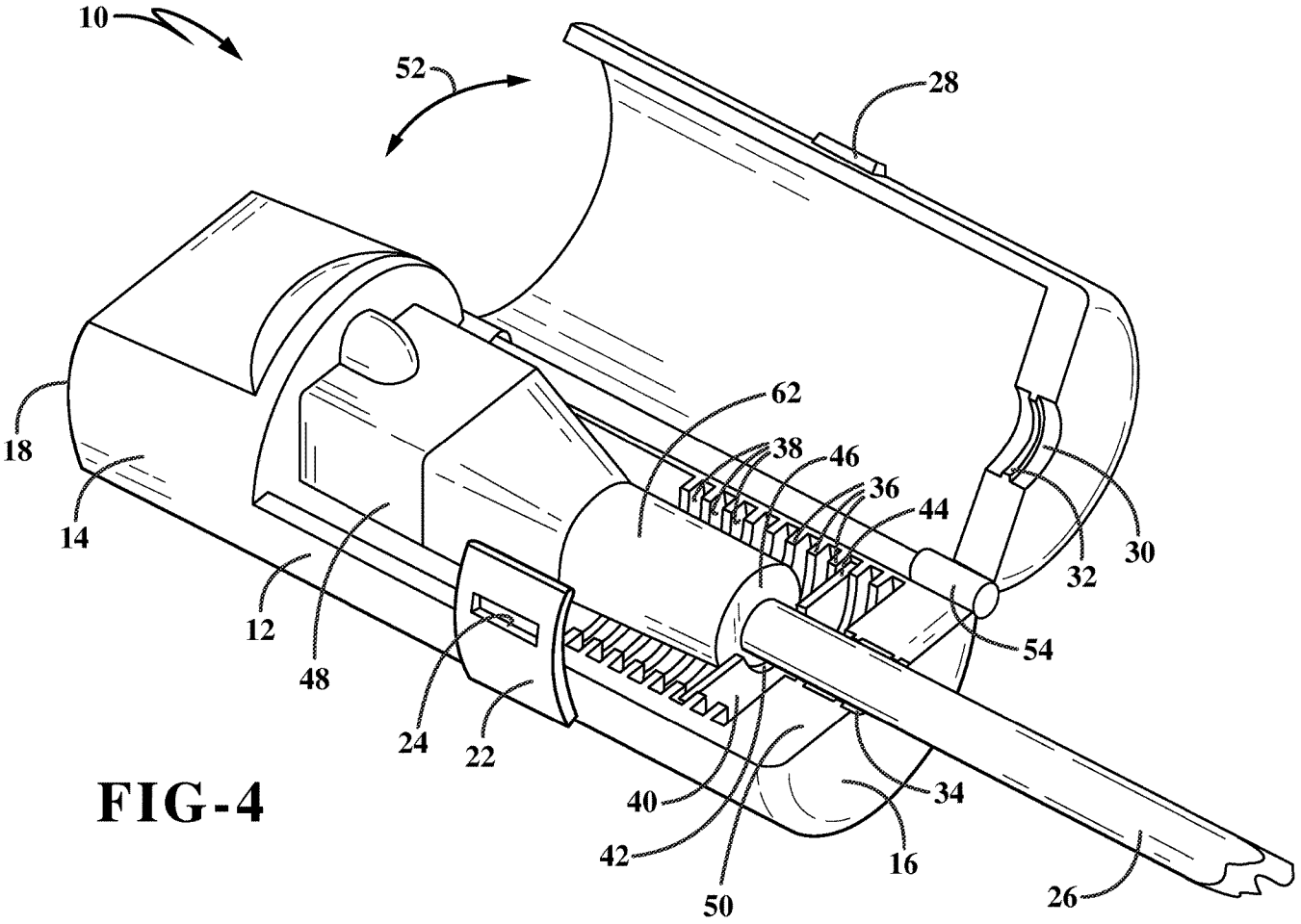
FIG. 4 is a perspective view of the power tap in the open position with a second electrical cable and plug therein.

FIG. 4 illustrates power tap 10 with an electrical cord having a longer electrical plug 62. In this implementation, the extra length of electrical plug 62 requires that retainer 40 be located a different position than shown in FIG. 2. As such, it is seen that any shape or size electrical plug which may fit within cavity 60 may be secured with retainer 40 so that the electrical plug and power tap remain connected.

Figure 5:
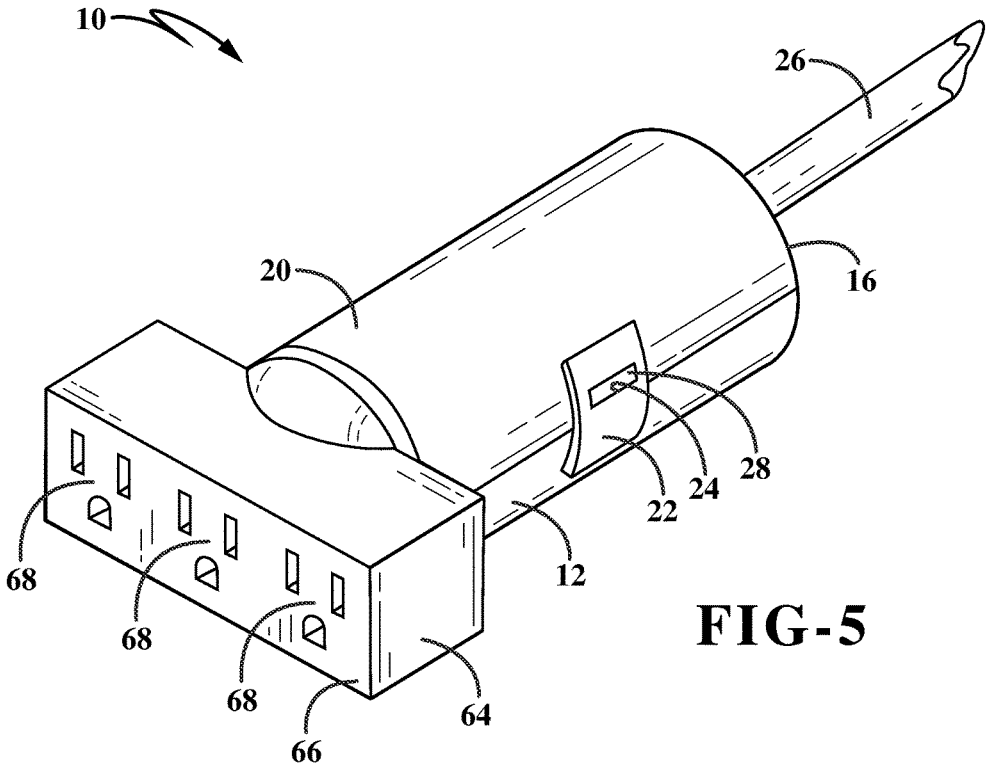
FIG. 5 is a perspective view of a second aspect power tap having multiple electrical receptacles.

FIG. 5 illustrates a power tap having a first end 64 with an electrical receptacle portion 66. Electrical receptacle portion 66 may include more than one electrical receptacle portions. In one implementation, three electrical receptacle portions 68 may be positioned on electrical receptacle portion 66. In any implementation, any number of electrical receptacle portions may be utilized to fit the appropriate application and the electrical receptacle portions may be female electrical receptacles.

Figure 6:
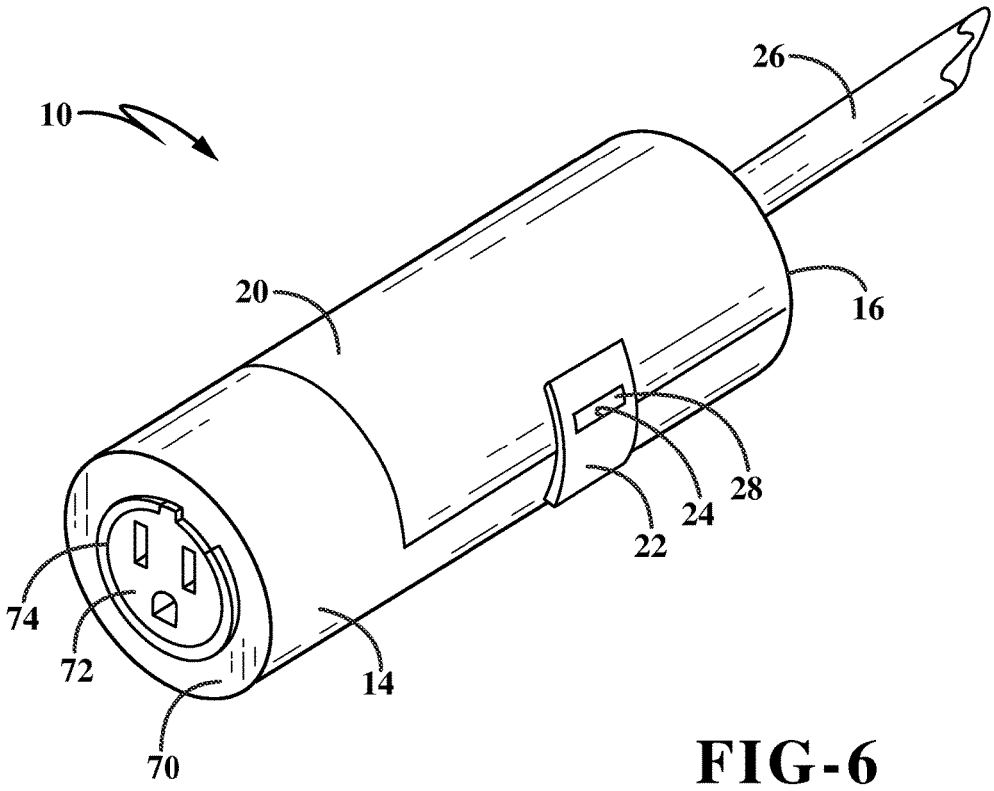
FIG. 6 is a perspective view of a third aspect power tap with a rotating electrical receptacle.

FIG. 6 illustrates a power tap with a locking mechanism positioned in end 70 which incorporates features disclosed in co-filed and pending application titled LOCKING ELECTRICAL DEVICE by the same inventors, the application of which is incorporated herein by reference. An electrical receptacle portion 72 may be rotatable from an unlocked position to a locked position defined by ring 74. In this implementation, a locking mechanism is activated when the electrical receptacle portion 72 is rotated in a clockwise direction until it contacts ring 74 which limits rotational movement. When the electrical receptacle portion 72 is rotated to the locked position, an electrical plug inserted therein is much more difficult to remove until the electrical receptacle portion 72 is rotated back in a counterclockwise direction. Accordingly a locking feature of the power tap helps to assist with safety and continued operation.

It will be understood that implementations are not limited to the specific components disclosed herein, as virtually any components consistent with the intended operation of a method and/or system implementation for a power tap may be utilized. Components may comprise any shape, size, style, type, model, version, class, grade, measurement, concentration, material, weight, quantity, and/or the like consistent with the intended operation of a method and/or system implementation for a power tap.

The concepts disclosed herein are not limited to the specific implementations shown herein. For example, it is specifically contemplated that the components included in a particular implementation of a power tap may be formed of any of many different types of materials or combinations that can readily be formed into shaped objects and that are consistent with the intended operation of a power tap. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the power tap may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of a power tap, it should be readily apparent that a number of modifications may be made without departing from the spirit thereof and that these implementations may be applied to other power taps. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

We claim:

1. A power tap comprising:

a body having a cover and an electrical plug receiving portion;

an electrical receptacle portion on the body;

a current transmitter connecting the electrical plug receiving portion and the electrical receptacle;

a tamper resistant assembly positioned within the electrical receptacle portion; and a plurality of slots positioned in a cavity within the body and arranged to receive a retainer;

wherein the retainer is positioned within the slots for contacting an electrical plug and preventing removal of the electrical plug when the retainer is in contact with the electrical plug; and, wherein the electrical receptacle portion is accessible from outside of the cavity when the cover is in a closed position.

2. The power tap of claim 1 wherein the electrical plug receiving portion further comprises a male electrical plug.

3. The power tap of claim 1 wherein the retainer is selectively positioned within the cavity at more than one position.

4. The power tap of claim 1 wherein the current transmitter is a plurality of wires.

5. The power tap of claim 1 wherein the cavity is cylindrical in shape.

6. The power tap of claim 1 wherein the retainer is a partial disk with a recessed portion.

7. The power tap of claim 1 wherein the electrical receptacle portion further comprises a female electrical receptacle.

8. The power tap of claim 7 wherein the electrical receptacle portion further comprises more than one female electrical receptacles.

9. The power tap of claim 1 wherein the cover allows access to the cavity when in an open position and does not allow access to the cavity when in a closed position.

10. The power tap of claim 9 wherein the electrical plug receiving portion is only accessible when the cover is in the open position.

11. The power tap of claim 9 wherein the cover further comprises a clasping mechanism.

* * * * *